US006595226B2

(12) United States Patent
Uemura

(10) Patent No.: US 6,595,226 B2
(45) Date of Patent: Jul. 22, 2003

(54) TELESCOPING WALKING STICK

(75) Inventor: Shinichi Uemura, Nagoya (JP)

(73) Assignee: Crystal Industrial Co., Ltd. (JP)

( * ) Notice: Subject to any disclaimer, the term of this patent is extended or adjusted under 35 U.S.C. 154(b) by 0 days.

(21) Appl. No.: 09/855,778

(22) Filed: May 16, 2001

(65) Prior Publication Data

US 2002/0170587 A1 Nov. 21, 2002

(51) Int. Cl.[7] ..... A45B 9/00

(52) U.S. Cl. ..... 135/75; 135/69; 403/109.3; 403/348

(58) Field of Search ..... 135/65, 68, 69, 135/75, 911; 403/109.1, 109.2, 109.3, 109.5, 109.6, 109.8, 348, 349, 377, 378

(56) References Cited

U.S. PATENT DOCUMENTS

| | | | | | |
|---|---|---|---|---|---|
| 2,856,943 | A | * | 10/1958 | Sparlin | 135/68 |
| 3,417,765 | A | * | 12/1968 | Slater et al. | 135/69 |
| 4,661,009 | A | * | 4/1987 | Tripp | 403/348 |
| 5,496,323 | A | * | 3/1996 | Dye | 403/348 |
| 5,549,407 | A | * | 8/1996 | Levi et al. | 403/109.5 |
| 5,755,245 | A | * | 5/1998 | Van Helvoort | 135/65 |
| 5,924,658 | A | * | 7/1999 | Shiery et al. | 403/109.1 |
| 6,126,359 | A | * | 10/2000 | Dittrich et al. | 403/349 |
| 6,142,526 | A | * | 11/2000 | Katz | 135/75 |
| 6,202,663 | B1 | * | 3/2001 | Uemura | 135/65 |
| 6,273,112 | B1 | * | 8/2001 | Sumida | 135/69 |
| 6,379,076 | B1 | * | 4/2002 | Reinhold et al. | 403/348 |

FOREIGN PATENT DOCUMENTS

| | | | | |
|---|---|---|---|---|
| EP | 295843 | * | 12/1988 | 403/109.3 |
| EP | 541935 | * | 5/1993 | 135/69 |
| JP | 05007505 | * | 1/1993 | 135/65 |
| WO | 8901747 | * | 3/1989 | 135/75 |

* cited by examiner

*Primary Examiner*—Lanna Mai
*Assistant Examiner*—Hanh V. Tran
(74) *Attorney, Agent, or Firm*—Bacon & Thomas, PLLC

(57) ABSTRACT

A stick structure. The stick structure is resiliently extensible and adjustable in length. The adjustment of length of the stick can be easily achieved by both right-handed and left-handed users. The stick includes multiple fitting tubes nested in each other and an adjusting/locating device and a resilient extensible device disposed at the fitting sections of the fitting tubes. When rotating clockwise or counterclockwise any of the fitting tubes, the rotary body is rotated to forcedly stretch apart the damper to tightly abut against the inner circumference of another fitting tube so as to easily adjust the length of the stick and fix the stick. In addition, depending on use in different environments, the stick is freely and resiliently extensible to a certain extent.

3 Claims, 9 Drawing Sheets

Fig.6a
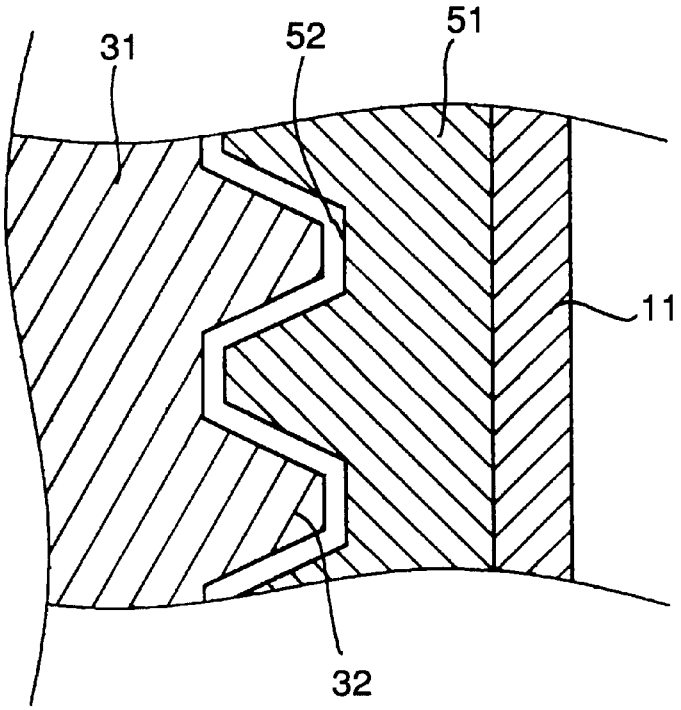
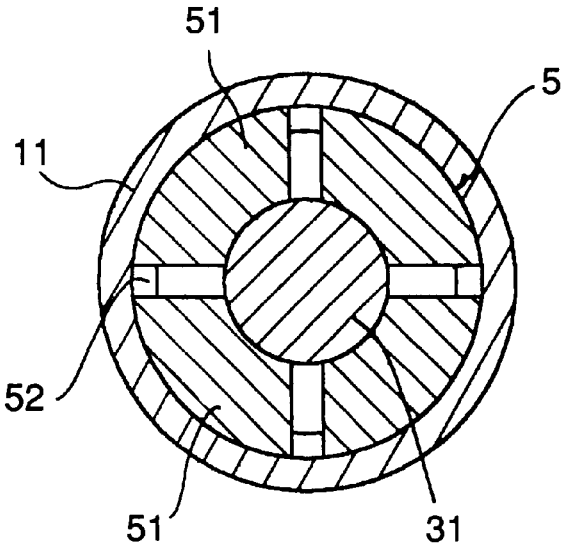
Fig.6b

Fig.7a
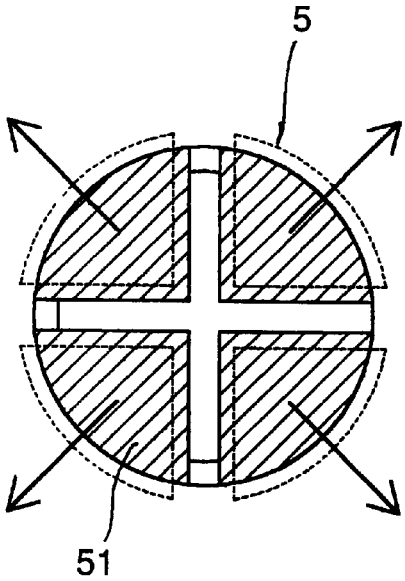
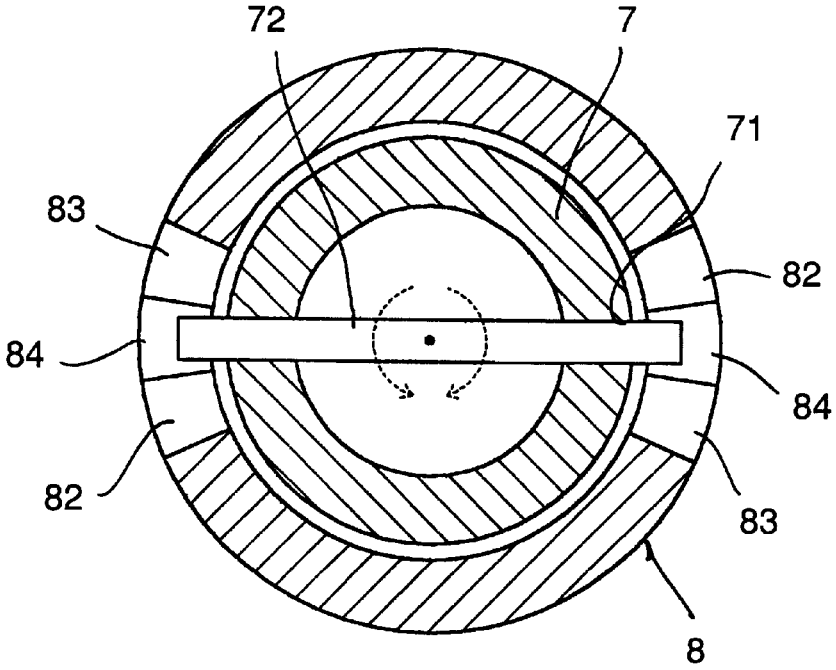
Fig.7b

Fig.8a
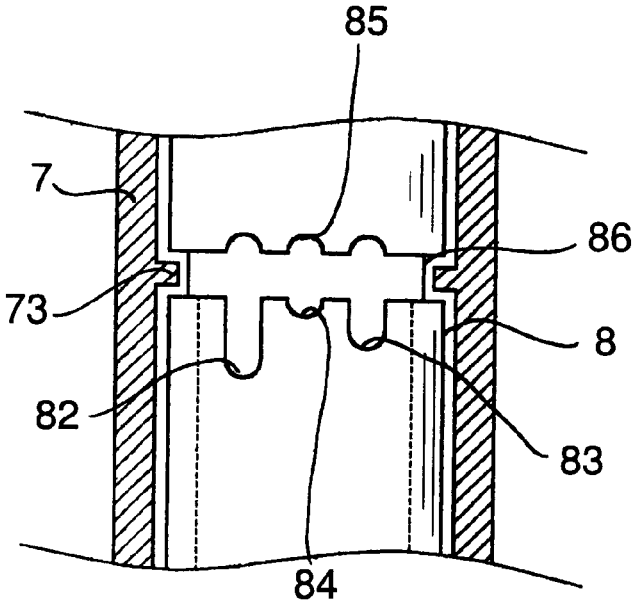
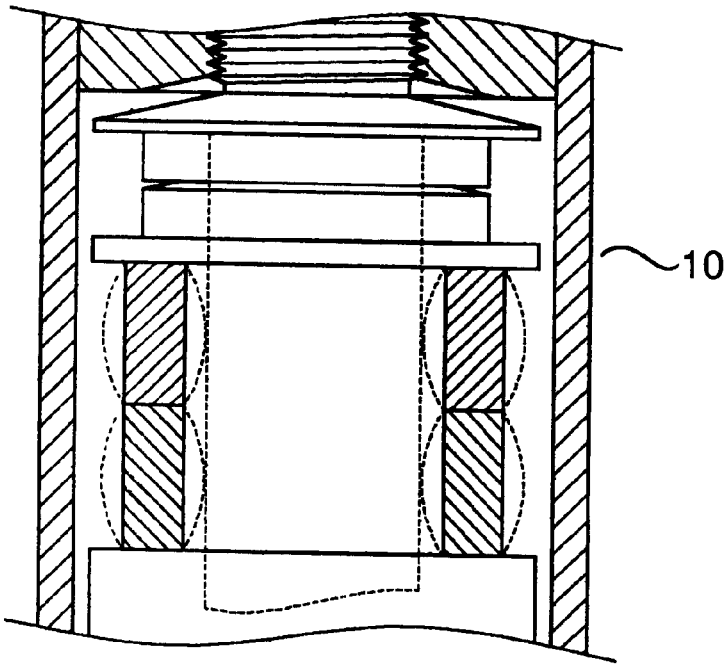
Fig.8b

TELESCOPING WALKING STICK

BACKGROUND OF THE INVENTION

The present invention is related to a stick which is resiliently extensible and adjustable in length. The adjustment can be easily achieved by both right-handed and left-handed users.

Japanese Patent Publication No. 7-49004 discloses a stageless adjustment device for a stick. A rotary shaft is integrally disposed on top end of the lower fitting tube of the stick. The rotary shaft has a central conic body formed with conic circumference. A resilient cylindrical damper and an eccentrically rotatable circular palate are screwed on the outer circumference of the rotary shaft. When rotating the lower fitting tube to press the circular plate against the inner circumference of the upper fitting tube, the damper is outwardly stretched by the rotary shaft to abut against the inner circumference of the upper fitting tube. Under such circumstance, the upper fitting tube is adjustably fixed with the lower fitting tube.

In the above stageless adjustment device, the circular plate is necessary. Such structure is complicated so that the manufacturing cost is relatively high. Moreover, the circular plate is likely to detach from the damper so that the adjustment device can be hardly durably used.

When fastening the upper fitting tube with the lower fitting tube, it is necessary to rotate the lower fitting tube in a fixed direction which is generally designed for a right-handed user. Therefore, it is inconvenient for a left-handed user to use the stick.

Furthermore, the stick with the above stageless adjustment device cannot be adjusted in accordance with the environment. Therefore, it often takes place that a user cannot conveniently and comfortably use the stick.

SUMMARY OF THE INVENTION

It is therefore a primary object of the present invention to provide a stick structure which has a stageless adjusting/location device and is resiliently extensible and adjustable in length. When clockwise or counterclockwise rotating a daughter fitting tubes, the daughter fitting tube will tightly abut against the inner circumference of a mother fitting tube so as to easily adjust the length of the stick and firmly fix the stick at the length. The adjustment of length of the stick can be easily achieved by both right-handed and left-handed users.

The present invention can be best understood through the following description and accompanying drawings wherein:

BRIEF DESCRIPTION OF THE DRAWINGS

FIGS. 6*a* and 6*b* are sectional views showing the structure of a part of an embodiment of the present invention;

FIGS. 7*a* and 7*b* are sectional views showing the structure of a part of another embodiment of the present invention and the operation thereof;

FIGS. 8*a* and 8*b* are sectional views showing the structure of a part of still another embodiment of the present invention.

DETAILED DESCRIPTION OF THE PREFERRED EMBODIMENTS

Figure 1:
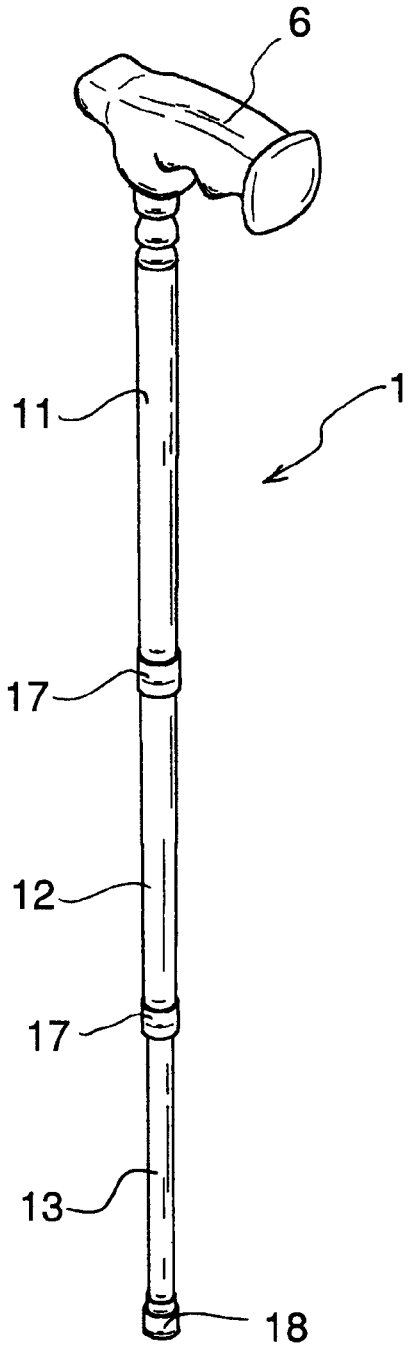
FIG. 1 is a perspective assembled view of the stick of the present invention.

Please refer to FIG. 1. The stick 1 of the present invention has a main body composed of an upper fitting tube 11, a middle fitting tube 12 and a lower fitting tube 13. A handle 6 is disposed at top end of the upper fitting tube 11. The middle fitting tube 12 is coaxially fitted with lower end of the upper fitting tube 11. The lower fitting tube 13 is coaxially fitted with lower end of the middle fitting tube to form a telescopic stick 1. Collars 17 are fitted on the ends of the fitting tubes 11, 12. A pad member 18 is disposed at bottom end of the lower fitting tube 13.

Figure 2:
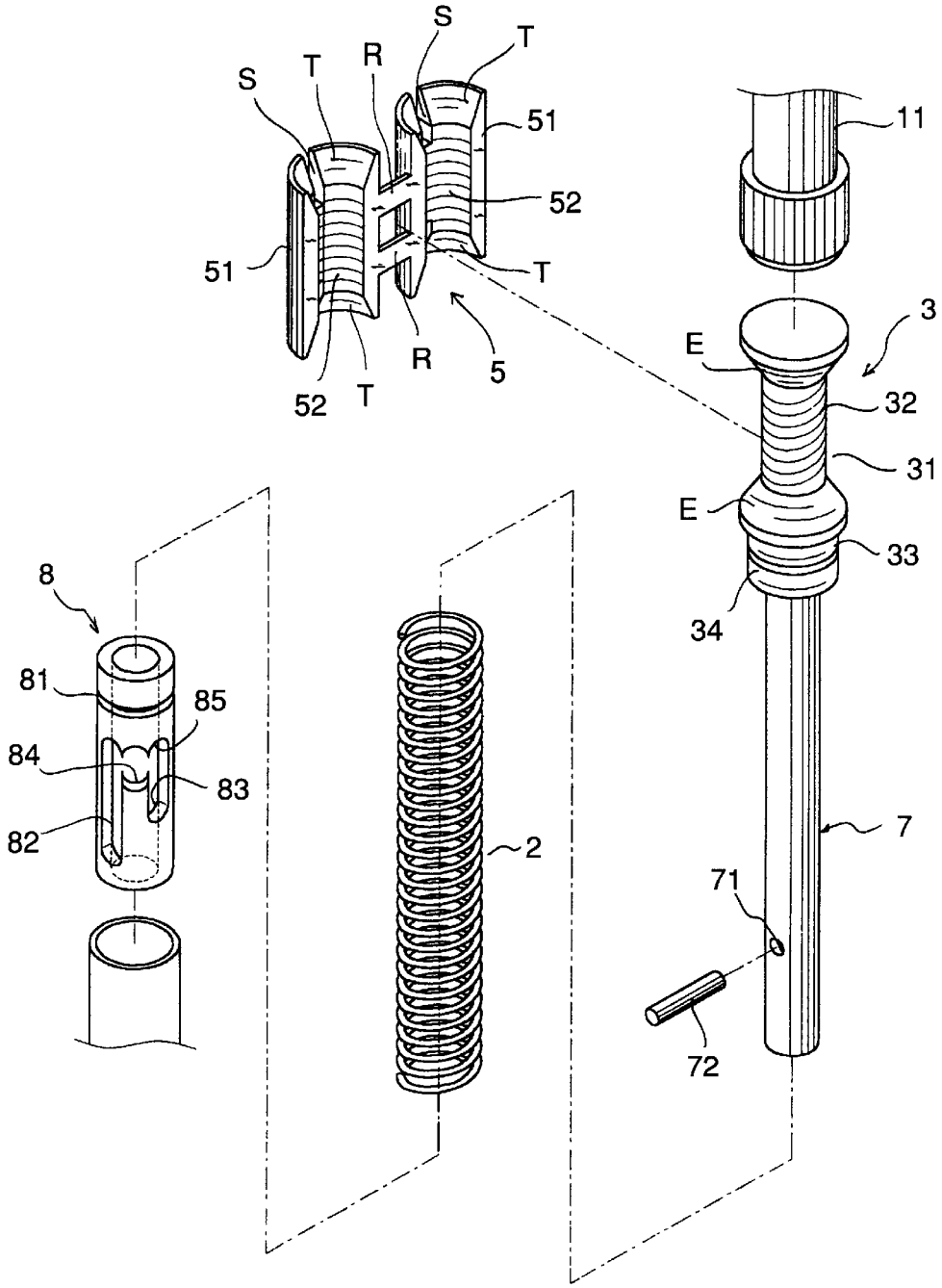
FIG. 2 is a perspective exploded view of the stick of the present invention.
Figure 3:
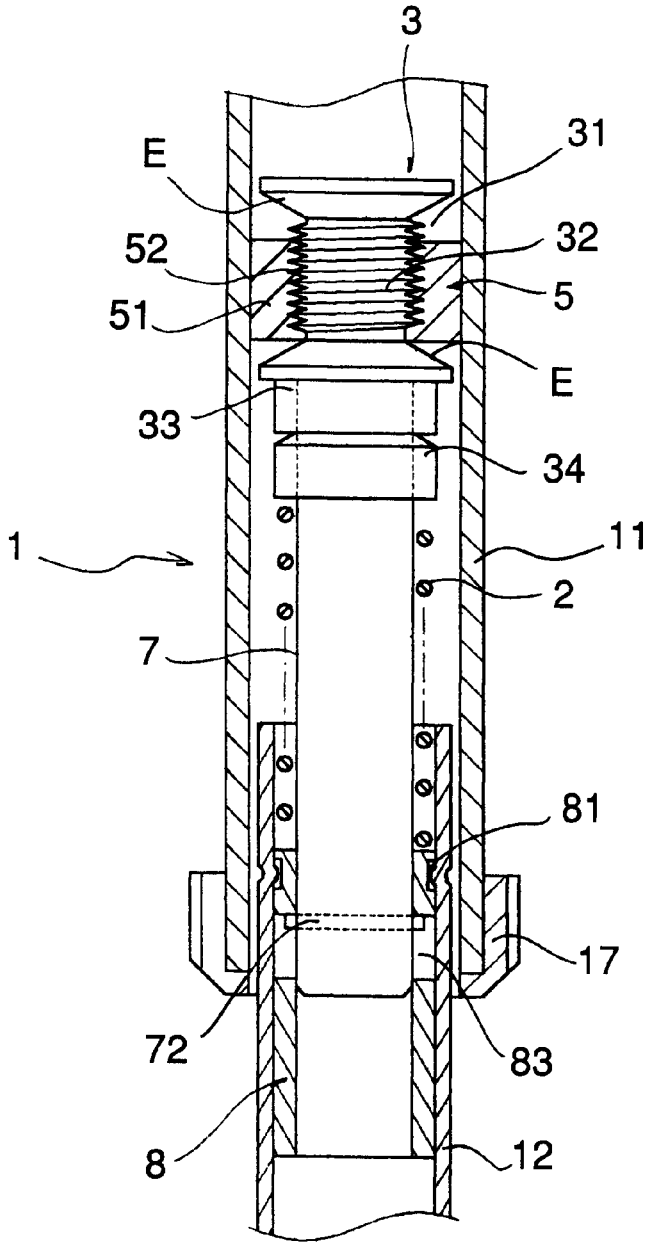
FIG. 3 is a sectional view of the adjustment device of the present invention.

Please refer to FIGS. 2 and 3. The stick of the present invention further includes a stageless adjusting/locating or adjustment device and a resilient extensible device.

The adjusting/locating device is composed of a rotary body 3 and a damper 5 and is disposed at the fitting sections of the upper, middle and lower fitting tubes 11, 12, 13. As shown in FIG. 2, the rotary body 3 is made of resin material and the outer circumference thereof is formed an outer thread 32 to form a thread rod 31. The lower end of the thread rod 31 is integrally formed with a cylindrical fixing section 34 connected with the thread rod 31 via a connecting section 33. The upper and lower ends of the thread rod 31 are formed with opposite conic faces E tapered toward the axis of the thread rod.

As shown in FIG. 2, the damper 5 is a cylindrical body composed of two semicylindrical bodies 51 made of high resilient resin. One side of each semicylindrical body 51 is connected with the other by a connecting plate R. The inner circumference of the semicylindrical body 51 is formed with inner thread 52 screwed with the thread rod 31 of the rotary body 3. The upper and lower sides of the inner thread 52 are formed with semielliptic arched faces T and cut with axial splits S.

When assembled, the fixing section 34 of the rotary body 3 is tightly fitted and located in the top end of the middle fitting tube 12 or the top end of the lower fitting tube 13. When rotating the middle or lower fitting tube 12, 13, the rotary body 3 is rotated along therewith. Then, the two semicylindrical bodies 51 are mated with each other to encompass the thread rod 31. Then, the associated damper 5 and the rotary body 3 are fitted with the middle fitting tube 12 and the lower fitting tube 13, making the outer circumference of the semicylindrical bodies 51 of the damper 5 lightly contact with the inner circumference thereof.

The resilient extensible device is composed of a spring 2 and a shaft insertion section 8 fitted on an adjustment shaft 7. As shown in FIG. 2, the spring 2 is compressible and restorable. The adjustment shaft 7 is made of high rigid metal and integrally coaxially connected with the fixing section 34. The adjustment shaft 7 and the fixing section 34 are synchronously operable. The lower end of the adjustment shaft 7 is formed with two opposite radial through holes 71 through which an insertion pin 72 is inserted.

As shown in FIG. 2, the shaft insertion section 8 is a hollow cylindrical body made of resin. The shaft insertion section 8 is up and down slidably fitted with the adjustment shaft 7 under the fixing section 34. The upper end of the shaft insertion section 8 is formed with an annular retaining groove 81. In addition, the circumference of the shaft insertion section 8 is formed with a long and a short axial escape slots 82, 83. A shorter restraining perforation 84 is formed between the long and short escape slots 82, 83 communicating the same with each other. Alternatively, as shown in FIG. 7*b*, the long and short escape slots 82, 83 and the restraining perforation 84 are diametrically symmetrically disposed on the shaft insertion section 8.

The long and short escape slots 82, 83 are different from each other in that one end of the long escape slot 82 axially extends by a longer length. However, the other ends of the long and short escape slots 82, 83 and the restraining perforation 84 are all formed with semicircular recesses 85.

When assembled, the spring 2 is first fitted onto the adjustment shaft 7 and lightly compressed, permitting the shaft insertion section 8 to fit with the adjustment shaft 7. Thereafter, the insertion pin 72 is passed through the through holes 71 of the adjustment shaft 7 to integrally connect the adjustment shaft 7 with the spring 2 and the shaft insertion section 8. At this time, two ends of the insertion pin 72 are positioned in the semicircular recess 85 of the restraining perforation as shown in FIG. 3.

Figure 4:
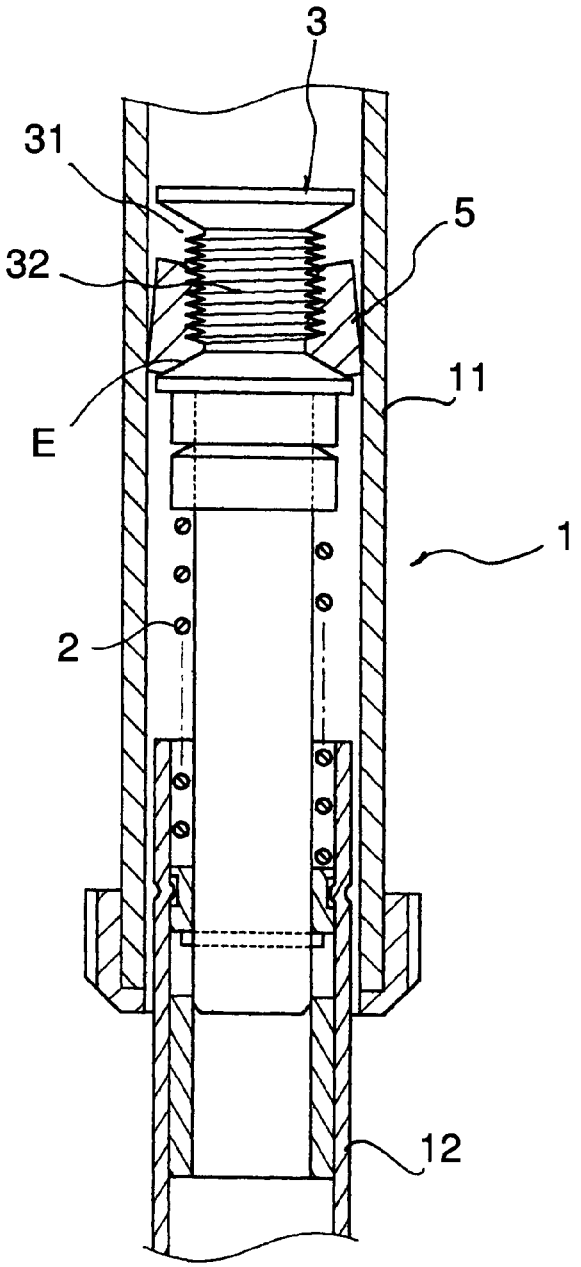
FIG. 4 is a sectional view showing that the present invention is rotated rightward.
Figure 5:
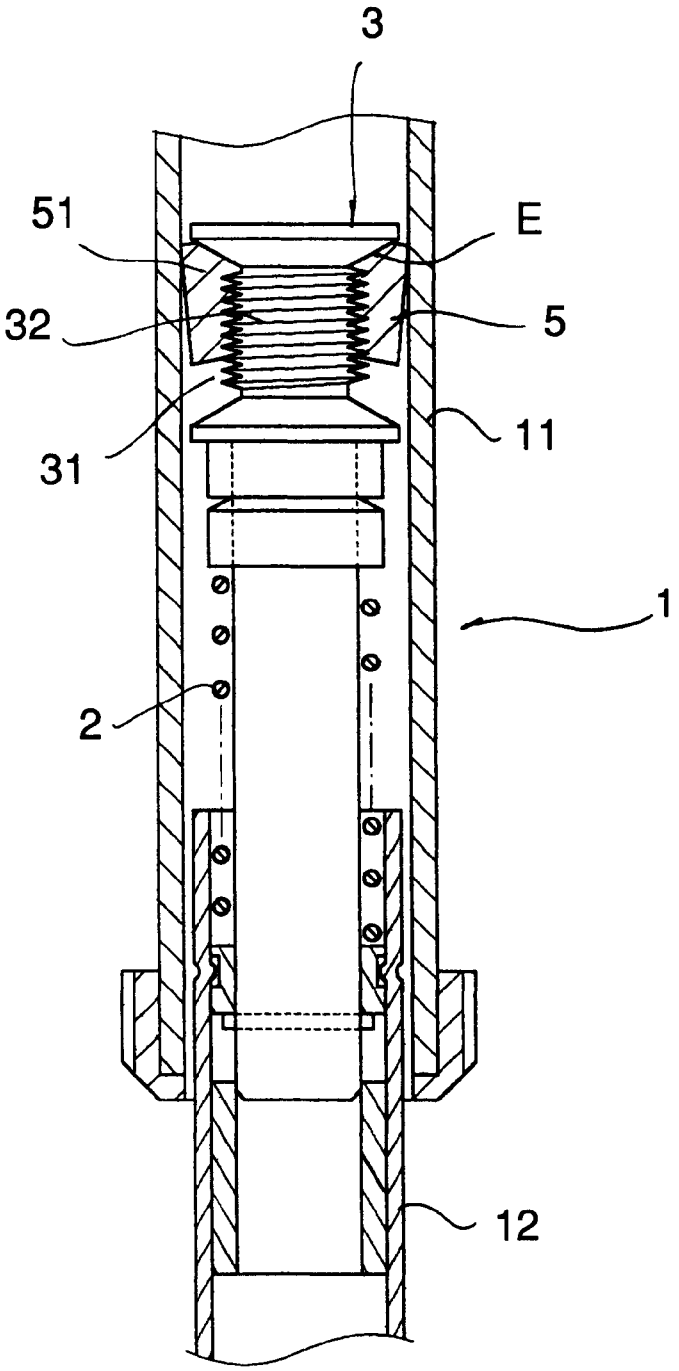
FIG. 5 is a sectional view showing the present invention rotated leftward.

In practical use, after the damper 5 is associated with the rotary body 3, in order to avoid clogging due to over-tightening of the inner thread 52 and the outer thread 32 during relative rotation, they are spaced from each other by a certain gap. The inner and outer threads 52, 32 are preferably trapezoid threads, whereby by means of lightest application force, a maximum tightness can be achieved as shown in FIG. 6*a*. When any of the upper, middle and lower fitting tubes 11, 12, 13 is not rotated, a downward fitting tube can be freely moved within the upward fitting tube and adjusted in length as shown in FIG. 6*b*. At this time, once the downward fitting tube is rotated, the rotary body 3 is rotated along therewith and moved upward. When the rotary body 3 is further rotated to make the two semicylindrical bodies 51 of the damper 5 in the upward fitting tube are forced by the conic face E of one end of the thread rod 31 of the rotary body 3 and gradually stretched apart toward the inner circumference of the fitting tube as shown in FIG. 7*b*. At this time, the two semicylindrical bodies 51 abut against the inner circumference of the fitting tube so as to firmly fix the downward fitting tube in the upward fitting tube. Accordingly, all the fitting tubes 11, 12, 13 are restricted from displacing. According to such operation, for both right-handed and left-handed users, they can hold the upper fitting tube with right hand and hold the lower fitting tube with left hand or hold the upper fitting tube with left hand and hold the lower fitting tube with right hand and relatively rotate the upper and lower fitting tubes so as to make the rotary body 3 forcedly stretch apart the damper 5 to tightly abut against the inner circumference of the fitting tube as shown in FIGS. 4 and 5.

Figure 9:
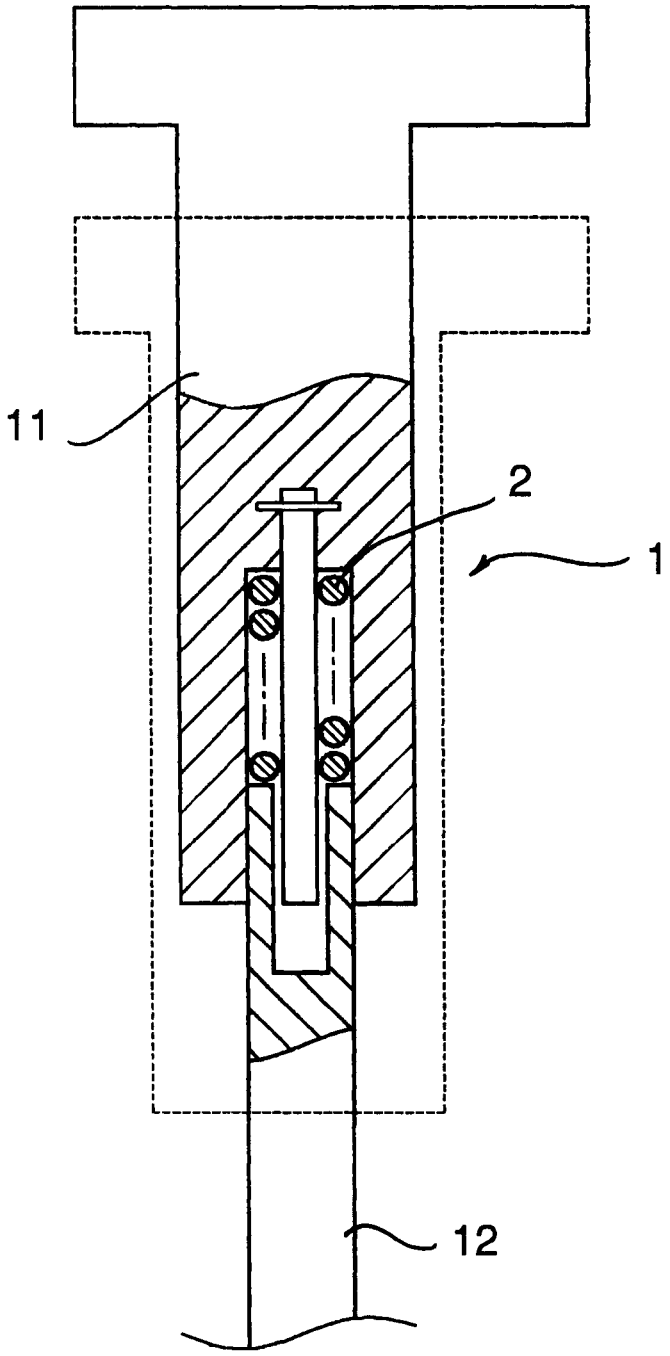
FIG. 9 is a sectional view showing the operation of the present invention.

Referring to FIG. 8, the shaft insertion section 8 and the adjustment shaft 7 of the resilient extensible device of the present invention is modified in structure. The circumference of the shaft insertion section 8 is formed with a shallow annular groove 86 passing through the long and short escape slots 82, 83 and the restraining perforation 84. In addition, the inner circumference of the adjustment shaft 7 is formed with a flange 73 slidable within the shallow annular groove 86. Referring to FIG. 9, when using the stick of the present invention, a user can freely selectively use the right hand or left hand to adjust the length of the stick to a personally optimal length for different environments. When used on a plane road face, the resilient extensible device can be located at the restraining perforation to form a fixed-type stick. When used on an inclined or irregular road face, the stick can be adjusted to a functional stick which is freely resiliently extensible to a certain extent.

According to the above arrangement, only by means of holding and rotating the fitting tube, the stick can be adjusted in length and then fixed. This can be easily achieved by both right-handed and left-handed users. The adjustment device has simple structure and can be easily assembled.

The above embodiments are only used to illustrate the present invention, not intended to limit the scope thereof. Many modifications of the above embodiments can be made without departing from the spirit of the present invention.

What is claimed is:

1. A telescoping walking stick structure comprising:

multiple fitting tubes nested in each other the overlapping portion of any two of said fitting tubes having an adjustment device and a resilient extensible device disposed therein;

wherein the resilient extensible device includes a spring, a shaft insertion section and an adjustment shaft, the spring being freely compressible and restorable and fitted around the adjustment shaft, a lower end of the adjustment shaft being formed with two opposite radial through holes through which an insertion pin is inserted;

the shaft insertion section is slidably fitted with the adjustment shaft, the upper end of the shaft insertion section being formed with an annular retaining groove, the circumference of the shaft insertion section being formed with long and short axial escape slots and a shorter restraining perforation positioned between the long and short escape slots; and the adjustment device comprising a rotary body, the rotary body comprising a pair of opposing conic faces positioned between an outer threaded portion, a resilient damper comprising opposing arched faces corresponding to respective ones of the conic faces of the rotary body, positioned between an inner threaded portion such that rotation of the rotary body will engage one of the arched faces of the resilient damper to press against a corresponding one of the conic faces of the rotary body and lock movement between adjacent ones of the fitting tubes at desired length of the walking stick structure.

2. The telescoping walking stick structure as claimed in claim 1, wherein the long and short escape slots and the restraining perforation are diametrically and symmetrically formed on the shaft insertion section.

3. The telescoping walking stick structure as claimed in claim 1, wherein the circumference of the shaft insertion section is formed with a shallow annular groove passing through the long and short escape slots and the restraining perforation, and the inner circumference of the adjustment shaft being formed with a flange slidable within the shallow annular groove.

* * * * *